US005092708A

United States Patent [19]

Krüger

[11] Patent Number: 5,092,708

[45] Date of Patent: Mar. 3, 1992

[54] BARRIER, IN PARTICULAR FOR DAMMING A TIDAL WATERWAY DURING STORM TIDES

[75] Inventor: Heinz Krüger, Wedel, Fed. Rep. of Germany

[73] Assignee: Noell GmbH, Würzburg, Fed. Rep. of Germany

[21] Appl. No.: 675,134

[22] Filed: Mar. 26, 1991

[30] Foreign Application Priority Data

Mar. 27, 1990 [DE] Fed. Rep. of Germany ..... 4010221

[51] Int. Cl.[5] ..... E02B 7/20

[52] U.S. Cl. ..... 405/103; 405/87; 405/114

[58] Field of Search ..... 405/63, 66, 87, 90, 405/103, 107, 114, 115

[56] References Cited

U.S. PATENT DOCUMENTS 3,916,628 11/1975 Halpern ..... 405/103
4,484,836 11/1984 Bailard ..... 405/103 X
4,493,587 1/1985 Ferrari ..... 405/114

FOREIGN PATENT DOCUMENTS 729333 12/1942 Fed. Rep. of Germany .
2503757 10/1982 France .
2642747 3/1978 United Kingdom .

OTHER PUBLICATIONS

H. H. Sass, Ein neues Konzept für Hochwasserschutzsperrwerke im Bereich der Grosschiffahrt, Springer-Verlag 1986, pp. 177-180.

*Primary Examiner*—David H. Corbin
*Attorney, Agent, or Firm*—Nils H. Ljungman & Associates

[57] ABSTRACT

The barrier proposed by the invention consists of gate elements or components which move on inclined planes, characterized by the fact that in the rest position on the edge of the waterway, preferably on the shore, the gate elements or components can be inserted inside one another in telescope fashion. With suitable lengths of the foundations forming the inclined planes, the gate elements which can be moved in tracks independently of one another can be removed completely from the water and pushed together above the average high water level.

The cross section of the gate elements has a triangular shape, whereby the ocean-side supports the dam wall and the inland side primarily absorbs the bracing forces.

20 Claims, 4 Drawing Sheets

BARRIER, IN PARTICULAR FOR DAMMING A TIDAL WATERWAY DURING STORM TIDES

BACKGROUND OF THE INVENTION

1. Field of the Invention

This invention relates to a barrier, in particular for damming a tidal waterway during storm tides.

2. Background Information

Barriers for storm tides are structures in tidal waterways with gates which are generally open. On one hand, such a configuration allows a substantially unrestricted flow of tide waves in both directions, and, on the other hand, such a configuration generally does not interfere with the passage of ships. The following requirements, among others, are generally placed by ocean-going shipping on the passage openings in tidal barriers:

On one hand, a ship channel at least 200 to 400 m wide and approximately 12 to 15 m deep at average low water should generally in no way be restricted by the structure. On the other hand, the overall cross section of the waterway should generally be changed as little as possible, to prevent any adverse effects on tidal flow.

It is known that, to meet these requirements, it is possible to use gates which rest on the bottom of the waterway. Furthermore, such gates may be raised by a hydraulic system or by the injection of compressed air. However, such gates may have the disadvantage that all the moving parts are constantly under water, making maintenance difficult. In addition to problems related to filling with sand, silt and deposits, major design problems must generally be overcome for gate heights of more than 20 m.

Also known are hose-type elastic structures disposed on the bottom of a waterway, which may form a barrier body when filled with water, and floatable gate bodies, which are usually supported on a bottom sill by being flooded and submerged. Both of these types of structures also tend to be unsafe under the worst imaginable conditions, or else may be difficult to control on account of their size.

The above-mentioned requirement for maintaining a wide ship channel also tends to rule out all structures in which the forces from the water pressure must be supported by lateral buttresses or supports, because the stability of the structures under load cannot generally be guaranteed. Therefore, the only designs which are usually suitable are those in which the forces exerted, such as by water pressure, may be transmitted directly to the foundation structure and into the river bottom. Such designs include, for example, sliding gates which can be moved on foundations, on a horizontal rail, out of dock-like chambers.

Such a sliding gate, having a triangular cross section, is disclosed in Federal Republic of Germany Patent No. 729 333, as, for example, a sliding gate for locks. Since the sliding gate moves horizontally, it should generally have, for the purpose of horizontal movement, a chamber which can hold the full length of the gate to be moved, in order to free up the entire width of the flow of the waterway. Such a structure tends to require a high construction expense, with consequent high costs. And on account of the rectangular gate surface, the entire flow profile is generally necessarily changed, and, consequently, the velocity of the current is usually increased. That, in turn, tends to have a negative impact on the expense with which the sill and the rails are kept clear, because constant impacts can be expected on account of the high flow velocity.

OBJECT OF THE INVENTION

The object of the invention is therefore the creation of a barrier which can be constructed at an appropriately large size, meets the requirements of stability under load, does not significantly change the cross section of the river, is inexpensive and easy to build, can be serviced and maintained easily, and guarantees reliable and safe operation in emergencies.

SUMMARY OF THE INVENTION

This object is achieved by means of features disclosed hereinbelow. Additional advantageous configurations are also described hereinbelow.

The barrier proposed to achieve the object of the invention comprises gate elements or components to preferably be moved on inclined planes, and has the unique feature that the gate elements can be telescopically moved into one another.

The inclined planes preferably comprise foundations which can be advantageously installed to fit the natural cross section of the river bed. The river cross section is thereby changed hardly at all. Furthermore, the natural cross-section is generally not even influenced to any great extent, in that:

1. There are substantially no effects on the tidal flow, and
2. the width of the ship channel is not reduced, thereby avoiding any restrictions on ship traffic.

Preferably, the track slope to be selected for the foundations is governed not only by the best fit of a preferably straight, inclined track to the irregular river profile. More particularly, since the width and height of the ship channel should generally not be restricted, the bottom depth of the main ship channel, at the lateral limit of the channel, preferably represents a reference point for the height or slope of the inclined planes, which inclined planes are preferably for guiding the movement of the gate elements. Consequently, the low point under the center of the ship channel is generally several meters below the theoretical bottom for navigation. In this way, the ship channel generally has the necessary water level for the draft of large ships, even for a relatively low water level.

The telescoping of the gate elements in a rest position reduces the space taken up by the elements when the elements are not being used. If the foundations forming the inclined planes are sufficiently long, the gate components may be raised completely out of the water, and pushed together, at least above an average high-water level. For this purpose, the gate components may have individual propulsion mechanisms, and may be moved independently of one another. In such a case, the storage of the gate components in their rest position out of the water is advantageous. As with the foundations, the tidal flow is not adversely affected and a protected and easy-to-maintain mounting of each individual gate component is achieved. In other words, by keeping the gate elements out of the water when the barrier is not in use, the tidal flow of the waterway is generally not influenced to a great degree.

The cross section of the gate elements preferably has a triangular shape, whereby the side oriented towards the ocean, or the ocean-side, supports the dam wall, and the side oriented away from the ocean, or the inland side, primarily provides bracing forces. The dam walls are preferably flat or curved. Curved walls may allow for the achievement of a more favorable transmission, into the foundation, of the forces which occur on the barrier. The angle between the legs, or sides, of the gate elements on the upper edge of the gate elements is preferably determined by corresponding calculations of the rigidity of the framework of the gate elements, and is furthermore determined on the basis of local conditions and on particular plans for the use of the barrier. Also, among other things, resistance to tilting and the clearance necessary for the telescoping process, for example, for the seals, should generally thereby be taken into consideration. A right angle at the peak, for example, may, when considering the corresponding polygon of forces, result in an optimum structure of an isosceles triangle. In such a structure, the dam wall side may be seen as a beam on two braces, which beam, on the bottom, rests in the track and, on the top, rests on the rear-side bracing structure.

Preferably, there are vertical end edges on the gate elements, wherever two elements must close in the middle of the river, with matching closures. The upper edge of each gate element preferably runs approximately parallel to the inclination of the inclined plane, but not more steeply than the latter, so that the upper edge, on the side towards the shore, also influenced by individual length and the slope of the track, is usually always higher than on the side towards the water current. Thus, there is preferably a difference in height between two elements, whereby the gate component closer to the shore is lower, in terms of this height difference, than the gate component closer to the middle of the river. When viewing the closed barrier, the barrier therefore may have a slightly sawtoothed contour. The lowest points of the upper edge are preferably on the level of the highest storm tides to be blocked, whereby any high waves are also taken into consideration. Above the shore, in the uppermost area of the triangular storm tide cross section to be gated, which connects approximately to the dike line and extends to the line of the average high water or slightly above it, a massive horizontal wall preferably connects the barrier to the shore. The top of this wall is preferably on the level of the maximum storm tide water level. In the rest position, the segments are preferably telescoped into one another over this wall.

In the closed position, wherein the barrier is extended into the waterway to block storm tides or floods, all the elements are preferably in close contact with one another and with the bottom. Preferably, the seals between the individual elements and on the bottom are arranged so that they are in complete contact only in a final closed position. In the intermediate positions and in the rest position, on the other hand, the seals preferably leave a flow gap free, which is preferably achieved by suitable shaping of the surfaces with which the seals come in contact. Dints in the tracks for the closed position of each gate element can also increase the effectiveness of the seal.

The intermediate seals are preferably installed on the inside of each gate element, on the edge facing the shore. In the closed position, the seals are preferably pressed against bead-shaped contact surfaces on the dam wall of the next-higher element.

The bottom seal, mentioned above, is preferably achieved by flexible steel plates which project ahead of the dam wall, and which have rubber profiles on their underside which run alongside the dam wall. These plates are preferably attached and sealed to the lower edge of the elements, because they are generally pressed by the water pressure against corresponding contact surfaces. The contact surfaces are preferably located in front of the front track of the gate component on the foundation.

On the foundations, the gate elements preferably run in tracks, whereby each gate component preferably runs in its own ocean-side and inland-side tracks. The tracks are preferably recessed in a trough-like manner in the foundations and preferably have diagonal edges, so that during the closing or opening movement, the gate components are substantially forcibly centered by the banked sides. This measure substantially meets the increased requirements for the stability of each element under load, since, particularly during the closing of the barrier, on account of the upward and transverse forces which are generally exerted simultaneously when the gate elements are moved, secure guidance and secure mounting in the final closed position are both highly desirable, so that the forces from the water pressure may be properly transmitted into the foundation structure or the bottom.

For guidance in the tracks, the gate elements preferably have rollers, and, to assist in the event of roller failure, skids. The skids may also function as braces if the rollers should break. The rollers are preferably installed under the legs of the gate elements, so that longitudinal and transverse forces may be properly transmitted into the foundation. For example, to achieve a proper transmission of forces into the foundation, the rollers may be arranged at right angles to one another.

The flanks of the trough-shaped tracks, which are generally subjected to the loads applied by the rollers are preferably reinforced for withstanding the loads, and/or have corresponding inserts which may act as bearing surfaces. The mounting of the rollers may be elastic, which may make the movement smoother and quieter if there are vibrations.

Problems may be presented here by sand and silt deposits on the tracks. Such deposits, under some conditions, tend to produce severe increases in rolling resistance. Therefore, as a result of sweeper elements preferably installed on the lower edges of the gate components, which sweeper elements may be plates installed in front of and/or behind the rollers or skids, coarse and fine obstacles may simply be removed, preferably by being pushed to one side as with sweeper blades. Sand and any other deposits can be flushed off with flushing nozzles preferably located on the foundation and fed by means of pressurized water pipes. In a particularly advantageous arrangement, the nozzles and pipes are preferably laid directly in the trough-shaped tracks, or the nozzles may be pointed into the tracks. It would also be possible to equip the gate elements with flushing nozzles, and to supply the nozzles via pumps integrated into the barrier structure.

Of course, the barrier according to the invention may also be used to block the course of a river. In the closed position, the river water is dammed up ahead of the barrier and prevented from flowing out. A barrier of this type can be used, for example, to store water during droughts or dry periods, or to protect populated areas downstream from the barrier from flooding. In narrow valleys, the barriers may be concealed, for example, in chambers provided for that purpose in the walls of the valley.

One aspect of the invention resides broadly in a barrier apparatus for retaining water in a body of water, such as for damming a tidal waterway in the event of a storm tide, the body of water having a bottom, a first shore and a second shore, the barrier apparatus comprising: a plurality of barrier elements for retaining water; at least some of the barrier elements being adjacent to one another; and the plurality of barrier elements having means for telescopically retracting at least some of the barrier elements into adjacent barrier elements and for telescopically extending at least some of the barrier elements such that the barrier apparatus extends towards the first shore during the extending of at least some of the barrier elements.

Another aspect of the invention resides broadly in a method of utilizing a barrier apparatus for retaining water in a body of water, such as for damming a tidal waterway in the event of a storm tide, the body of water having a bottom, a first shore and a second shore, the barrier apparatus comprising: a plurality of barrier elements for retaining water; at least some of the barrier elements being adjacent to one another; and the plurality of barrier elements having means for telescopically retracting at least some of the barrier elements into adjacent barrier elements and for telescopically extending at least some of the barrier elements such that the barrier apparatus extends towards the first shore during the extending of at least some of the barrier elements; and the method comprising the steps of: telescopically extending at least some of the barrier elements such that the barrier apparatus extends towards the first shore during the step of telescopically extending and retains water in the body of water; and telescopically retracting at least some of the barrier elements into adjacent barrier elements.

BRIEF DESCRIPTION OF THE DRAWINGS

The invention is explained in greater detail below with reference to an embodiment illustrated in the accompanying schematic diagrams. The accompanying diagrams are generally not drawn to any scale.

DESCRIPTION OF THE PREFERRED EMBODIMENTS

Figure 1:
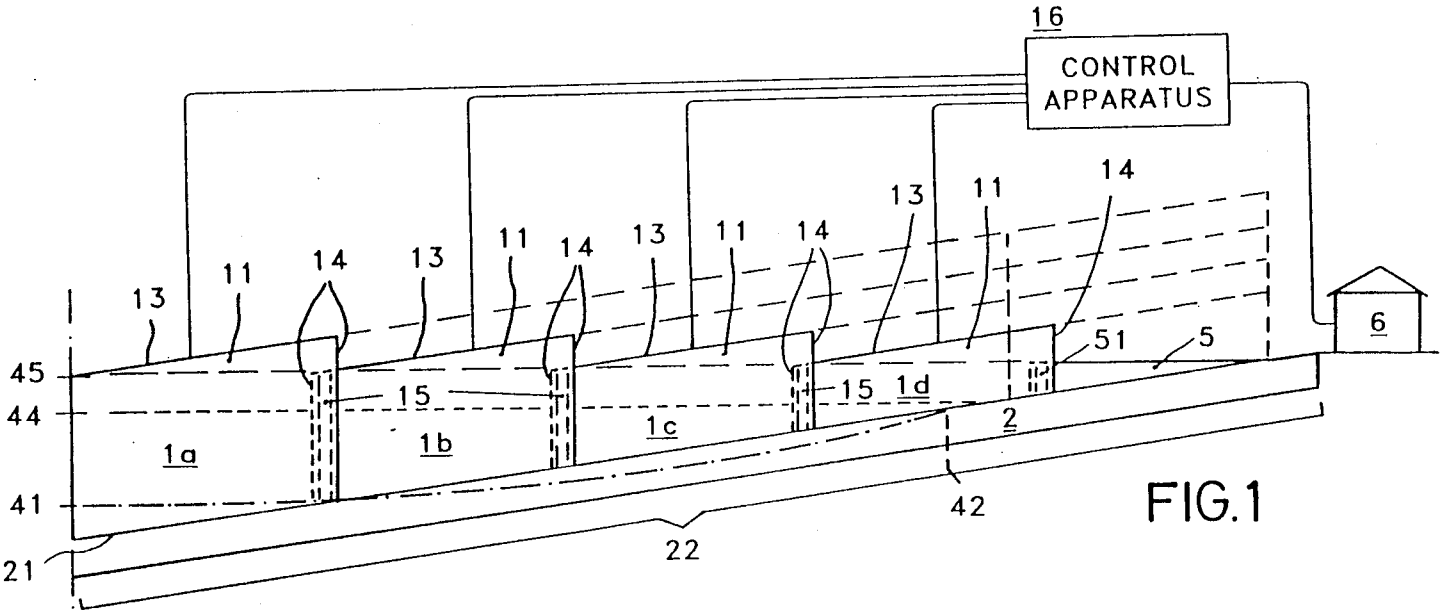
FIG. 1 shows a greatly exaggerated side view of one-half of the barrier in a closed position.
Figure 2:
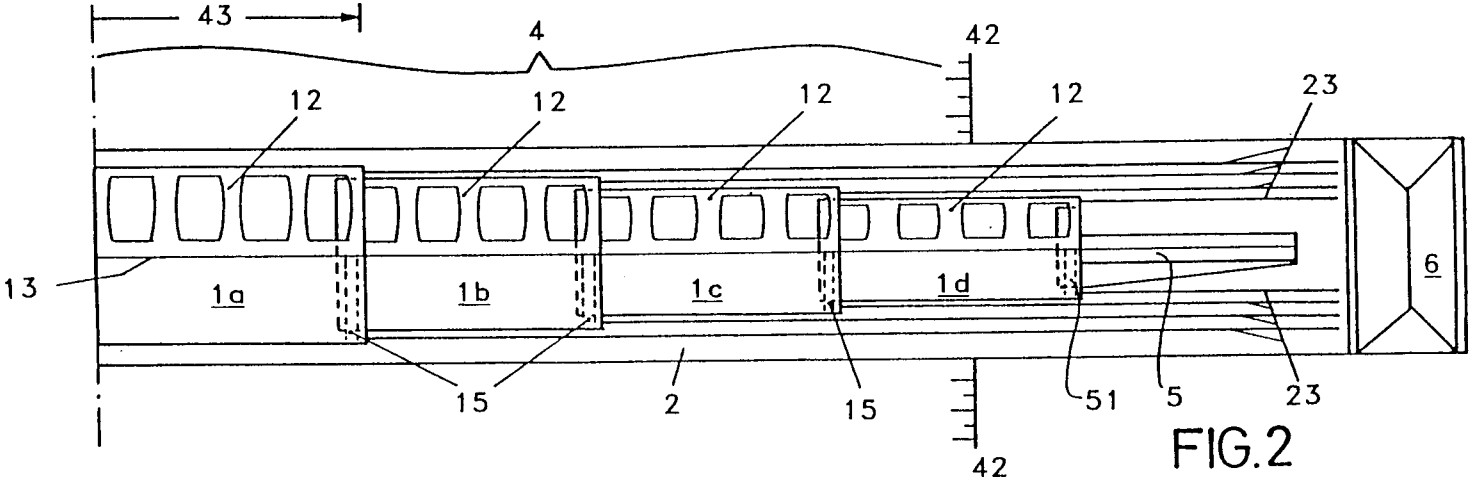
FIG. 2 shows a plan view of the barrier illustrated in FIG. 1.

As seen in FIGS. 1 and 2, tidal waterway 4 may have, in places, an original bottom 41 as illustrated by the dotted-dashed line in FIG. 1. The original river bottom 41 shown generally runs at an angle up to a shore or bank 42 of the waterway and is generally flattened in the middle. At the barrier, a bottom 21 of the waterway 4, which waterway is illustrated in FIG. 2, and which bottom substantially replaces the original river bottom 41 at the barrier location, comprises a foundation 2. The foundation 2 may form an inclined plane 22, which plane preferably begins from points above the river bank to the deepest point of the waterway, which point may be approximately in the middle of the river. In the vicinity of the bank 42, the bottom 21 is may be generally flatter and/or smoother, and, in the middle of the waterway 4, may be deeper than the original bottom 41. The latter characteristic is generally to the advantage of a ship channel 43 in the middle of the river.

FIG. 2 shows tracks 23 of dam walls 11 and bracing walls 12 on the foundation 2. Together, a dam wall 11 and a bracing wall 12 together preferably form one gate element 1*a* to 1*d*. The bracing walls 12 generally have no covers and preferably have openings between their beams.

FIG. 1 is the ocean-side view of one-half of the barrier in a closed position, or a position in which the barrier is extended and thus prepared to counter a storm tide or flood. As shown, reference number 44 indicates what may be an average high water level, and reference number 45 indicates what may be a maximum high water level.

The illustrations of FIGS. 1 and 2, showing the closed position, show how the gate elements 1*a* to 1*d* may overlap under one another on their vertical end edges 14. Elements 1*a*–1*d* also preferably have seals 15 on the overlapping points of the dam walls, which seals preferably come into contact with bead-shaped contact surfaces (not shown) on the next-higher element. The seals 15 are preferably elastic in nature. The gate elements 1*a* to 1*d* all preferably have an identical shape, but may be of different sizes. The upper edges 13 of the elements 1*a*–1*d* are preferably inclined in relation to the inclined plane 22, but may also be configured differently from those illustrated; for example, they may be flatter. The elements 1*a* to 1*d* preferably become smaller going from the middle of the river to the shore, and are designated by the letters a to d. In FIG. 1, for example, elements 1*a*–1*d* are illustrated in a substantially exaggerated manner.

In practical terms, as an example, one side of the barrier may be formed by about 3 to 5 elements, whereby the height of the largest element may be between about 25 and about 30 m and the lengths of the elements may be between about 100 and about 200 m. The overlaps for the intermediate seals 15 may be between about one and generally several meters long, for example. For the seals of the uppermost movable gate element 1*d*, a wall 5 with a corresponding contact surface 51 may be constructed on the upper portion of the inclined plane 22. Above this wall 5, the gate elements 1*a* to 1*d* are preferably inserted in one another telescopically, above the average high water level 44, as shown by the dashed lines in FIG. 1.

To move the gate elements 1*a* to 1*d*, lantern gears or toothed racks may be used, among other things, and the opening movement may also be assisted by traction means driven by winches. The required drive machines are preferably installed in a machine house 6.

Preferably, each of the gate elements 1*a*–1*d*, as well as the drive machinery in machine house 6, is also connected to a control apparatus 16, which may be located in the machine house 6 or in a separate location. Control apparatus 16 may include an electrical arrangement with simple switches. Preferably, control apparatus 16 is provided to allow for each of the gate elements 1*a*–1*d* to be seperately driven. In this way, the gate elements 1*a*–1*d* may be driven separately, in pairs, or in any combination or configuration desired by an operator. Examples of such combinations and configurations are discussed further below in relation to FIG. 5.

Figure 3:
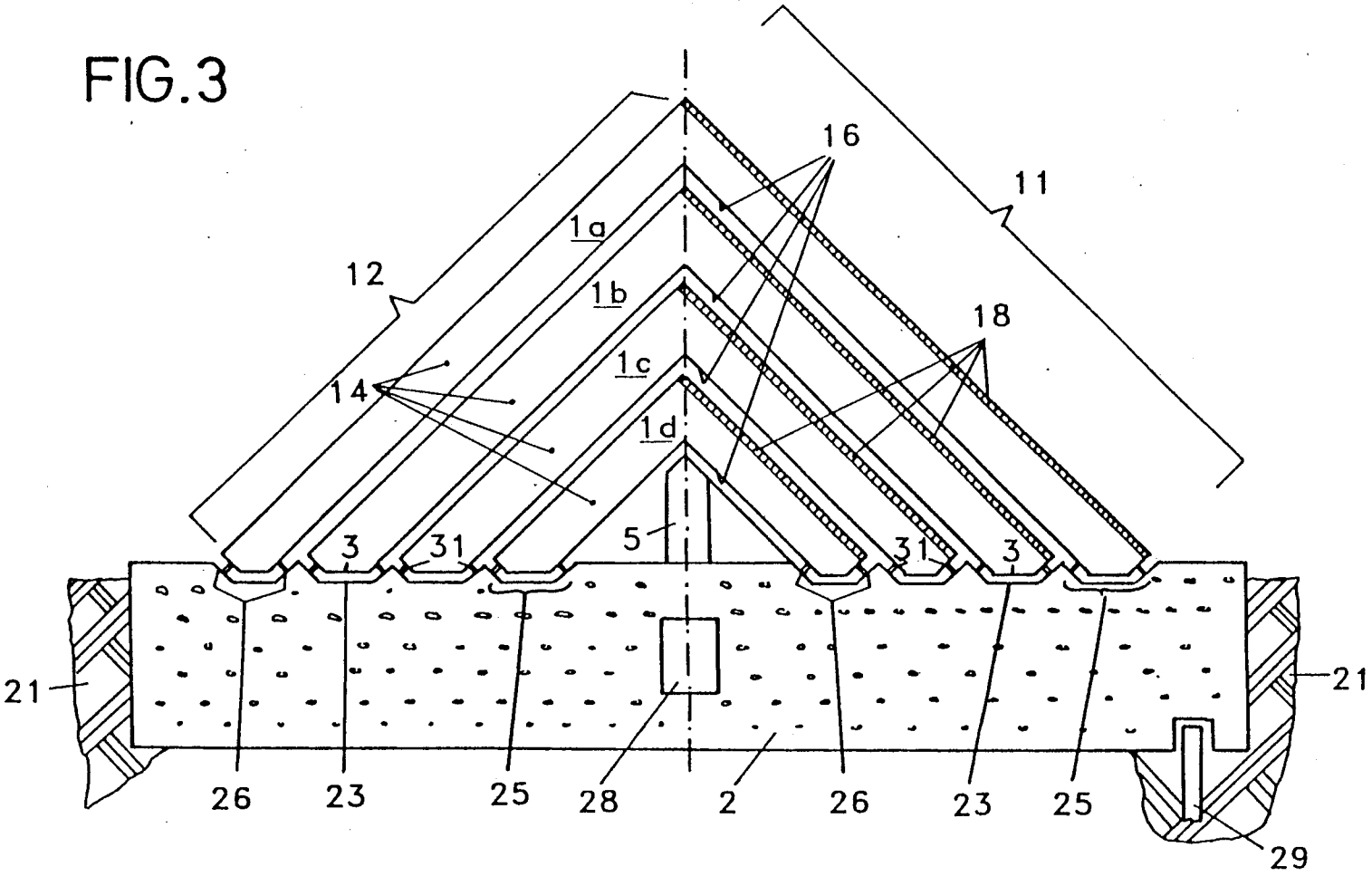
FIG. 3 is a cross section through the foundation with the gate elements in a rest position.

FIG. 3 shows a cross-sectional view of the foundation 2, preferably made of concrete. The foundation 2 preferably includes, among other things, cable ducts (not shown) and galleries 28. One such gallery which is shown here by way of example, located in the center of the foundation 2. Below the dam wall side of the gate elements 1*a* to 1*d*, the foundation 2 is preferably anchored in either the ground or the bottom of the waterway 21 and is preferably protected against scouring and erosion.

The tracks 23 for the bracing walls 12 and the dam walls 11 may be located on the foundation 2. These tracks 23 preferably have the same configuration for both dam walls 11 and bracing walls 12, and preferably have a substantially trough-shaped cross section with diagonal flanks 26. The generally identical lower edges 3 of all the gate elements 1*a* to 1*d* are preferably in contact with the flanks of the trough-shaped track 23 by means of rollers 31.

The flanks 26 are preferably at an angle of 45 degrees and the rollers 31 of the gate elements 1*a* to 1*d* may, accordingly, be oriented at a right angle to one another. The arrangement of the rollers 31 or the slope of the flanks 26 thus may allow for a favorable support of the dam and bracing walls 11, 12. Additional configurations with flanks inclined at different angles are conceivable, to which the rollers 31 may be adapted. A combination of flanks at different inclinations in one track or group of tracks 23 may also be possible, as a function of the dam wall 11 or bracing wall 12.

The gate elements 1*a* to 1*d* are shown in a rest position, pushed together above the wall 5. The seal 15 (See FIGS. 1 and 2) on the inside 16 on the end edges 14 of the gate elements 1*a*–1*d* is not shown. On the dam walls 11, skinplates 18 of the gate elements are indicated by hatch-marks.

Figure 4:
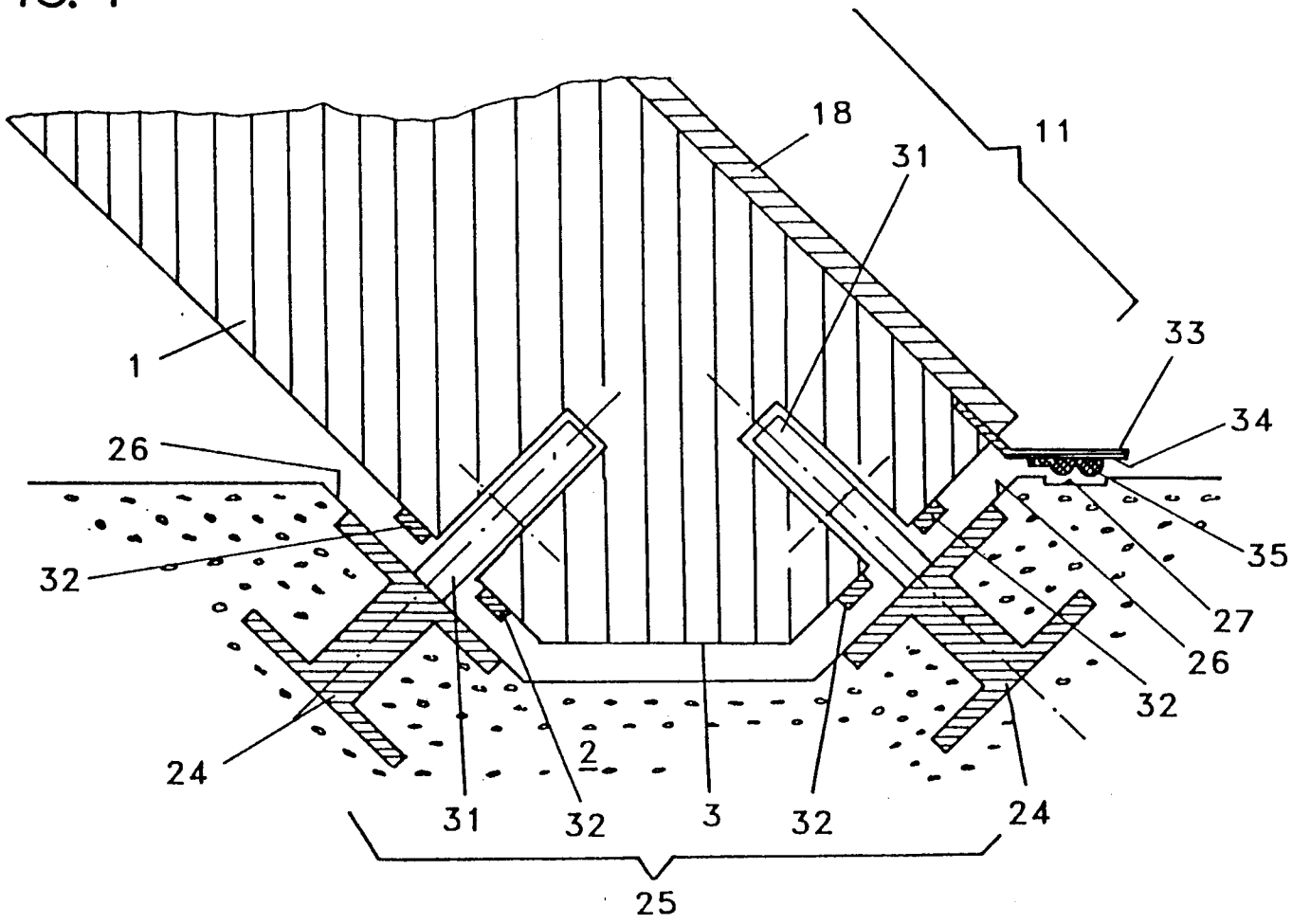
FIG. 4 shows a partial cross section through a track and a dam wall travelling in the track.

FIG. 4 shows an enlarged detail of a bottom edge 3 of a gate element in a track 23. The track flanks 26 preferably contain embedded reinforcements 24, such as H-beams, on which the rollers 31 may travel. The flanks 26 and reinforcements 24 may also be in the shape of a rail, as shown. Preferably, on both sides of a bottom edge 3 of the gate element, very near the rollers 31, there are preferably included skids 32, on which a gate element 1 may slide if rollers are not present.

In front of the dam wall 11, shown in partial cross section, of a gate element 1, a plate 33 preferably projects from a lower edge 3. A rubber profile 35 is preferably fastened to the underside 34 of the plate 33. The profile 35, which generally runs along the lower edge 3, is preferably laid into a contact surface 27, which preferably runs in a trough-like manner near track 23, on the ocean side of track 23. Preferably, profile 35 is pressed against the contact surface 27 by water pressure, thereby substantially preventing the seepage of sea water below the dam walls 11.

Figure 5:
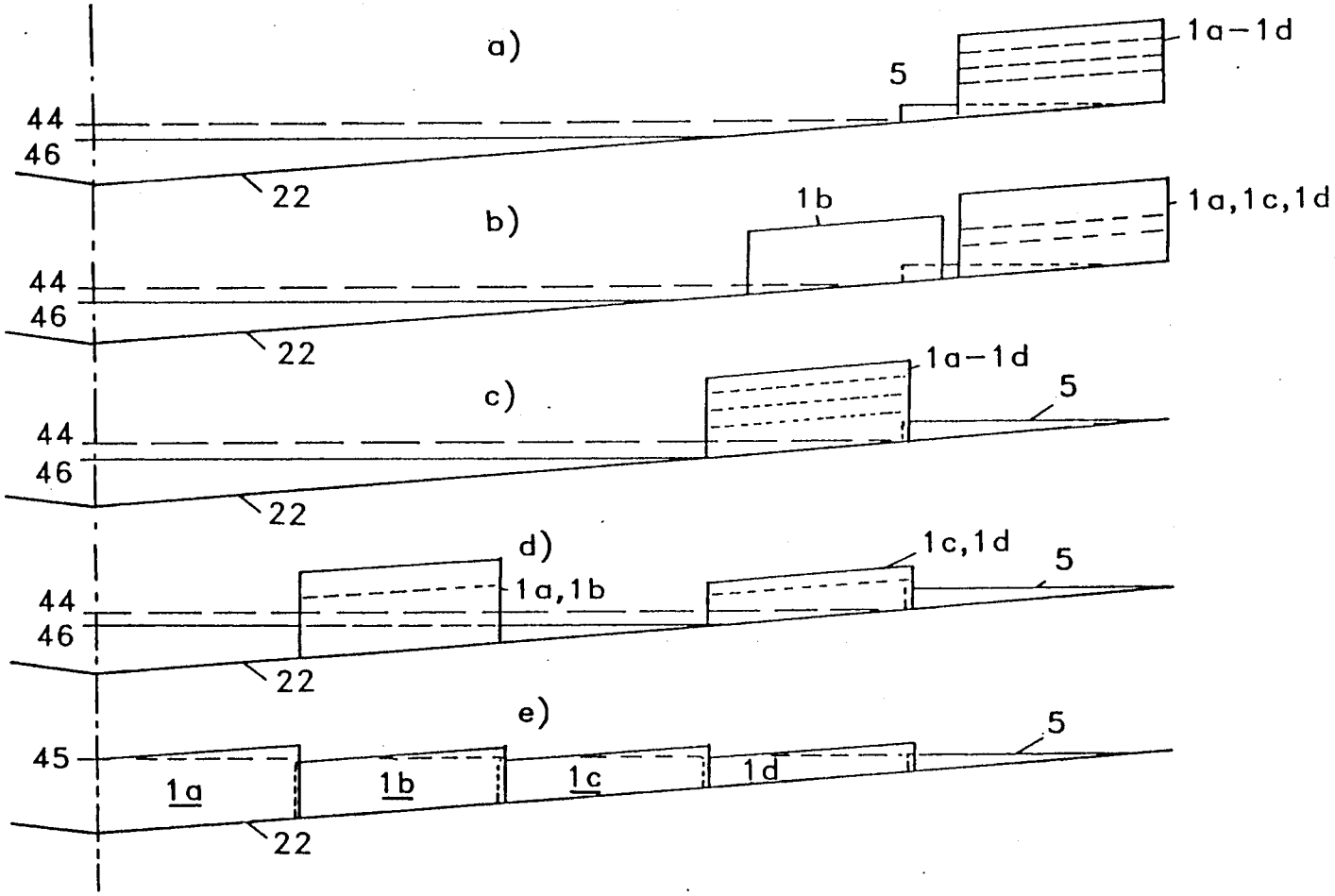
FIG. 5 shows one-half of the barrier under various operating conditions.

FIG. 5 shows various possible operating positions a to e of one-half of the barrier.

In Position a, all the gate elements 1*a* to 1*d* are in the rest position above the wall 5.

In Position b, one element, namely element 1*b*, has been extended ahead of the others, for example, for maintenance activities. At an average low water level 46, the element may be completely out of the water; at the average high water level 44, it may be partly in the water.

Position c is a position of readiness, and Position d is a position of increased readiness, when a storm tide is expected.

But as the cross section of the waterway becomes narrower, the speed of the current may be extraordinarily accelerated, and an increasing gradient may also be formed. That, in turn, tends to cause an increasing load on the gate elements 1*a* to 1*d*, and it may be problematic to quickly move the gate elements into the closed position one after the other. On account of the individual drive mechanisms and the mobility of the elements 1*a* to 1*d*, which may move independently of one another, it is possible to partly reduce the cross section of the waterway and to achieve a shorter closing time in emergencies, whereby, simultaneously, the main ship channel 43 may be kept open for a very long time, as shown in Position d. The barrier may also be opened therefrom correspondingly quickly, thereby generally reducing the time ship traffic is blocked.

Position e shows the barrier in the closed position, with the indicated maximum high water level 45. Since the current pressure of the rising water exerts significant additional forces on the moving gate elements 1*a* to 1*d*, it is generally advantageous to provide flow openings for relief in the dam walls 11 of the individual elements 1*a* to 1*d*. Preferably, these relief openings are configured to be closed only after the gate element has reached the final closed position, e.g. by rollers on suitable rails or louvered gates.

As a function of the overall height of the elements 1*a*–1*d*, various devices may be considered which can also make the height of the upper edge of the gate element changeable, such as a structure with hanging flaps in a frame structure.

The diagonal upper edge corresponding to the slope of the track must be replaced by a horizontal support structure for the mounting of the wickets of the weir. The wickets, which are held approximately horizontal during the movement of the elements, are lowered into the diagonal position only for the final closing, which corresponds to the slope of the dam walls of the other gate elements.

To recapitulate, the storm tide flood barriers of the prior art for damming tidal surges have the particular disadvantages of expensive construction, a modification of the river cross section, complex and expensive methods to keep them clear of sand and silt deposits, and difficult service and maintenance. It must also be possible to maintain a continuous ship channel at least 200 to 400 m wide with sufficient depth at average low water.

One feature of the invention resides broadly in a barrier, in particular for the damming of a tidal waterway in the event of a storm tide, with a barrier having an approximately triangular cross section shape, whose one inclined wall forms a dam wall 11 and whose other wall forms a bracing wall 12, which walls are connected to one another via a common upper edge 13, and which can be moved on a foundation 2 between a rest position on the edge of the waterway and a closed position in the waterway, characterized by the fact that: the barrier comprises several movable gate elements 1*a*, 1*b*, 1*c*, 1*d*; that the foundation 2 forms inclined planes 22 adapted to the bottom of the waterway 21, on which the gate elements 1*a*, 1*b*, 1*c*, 1*d* can be moved; that all the gate elements 1*a*, 1*b*, 1*c*, 1*d* have a geometrically similar triangular cross-section shape, but are of different sizes as a function of their position in the closed position, and are configured and arranged so that in the rest position they are telescoped into one another on the edge, preferably on the shore of the waterway, and in the closed position they are extended as a function of their size to the deepest point of the waterway, and; that on the end edges 14 of the skinplates 11, there are elastic seals 15, which in the closed position always close the gap between two overlapping gate elements 1*a*, 1*b*, 1*c*, 1*d*.

Another feature of the invention resides broadly in a barrier characterized by the fact that the end edges 14 of the dam wall and the bracing wall 11, 12 of the gate elements 1*a*, 1*b*, 1*c*, 1*d* are designed at least in part so that they define vertical planes.

Yet another feature resides broadly in a barrier characterized by the fact that the dam wall 11 is curved or arched and that the bracing wall 12 is configured in the manner of a frame.

A further feature of the invention resides broadly in a barrier characterized by the fact that the foundation 2 contains 2 parallel tracks 23, the tracks 23 run along the inclined plane 22, and have a trough-shaped cross section 25, whereby the cross section 25 has diagonal flanks 26.

A yet further feature of the invention resides broadly in a barrier characterized by the fact that the gate elements 1*a*, 1*b*, 1*c*, 1*d* are guided with elastically mounted roller and/or skid devices, which are located on the bottom edges 3 of the gate elements 1*a*, 1*b*, 1*c*, 1*d*, each in a track 23 under the dam wall 11 and a track 23 under the bracing wall 12, and are braced at least on the flanks 26 of the trough-shaped cross section 25, whereby they are self- centering.

A still further feature of the invention resides broadly in a barrier characterized by the fact that on the bottom edges 3 of the gate elements 1*a*, 1*b*, 1*c*, 1*d* there are sweeper elements, which consist at least partly of plates in front of and behind each roller and/or skid apparatus 31, 32.

A still yet further feature of the invention resides broadly in a barrier characterized by the fact that there are water pipes on the foundation 2 which are located at least partly in the tracks 23, 24, whereby the water pipes have nozzles from which pressurized water is discharged, and the tracks 23 are flushed clean or cleared by the pressurized water.

A still yet another feature of the invention resides broadly in a barrier characterized by the fact that the seals 15 on the end edges 14 of the dam walls 11 are installed on the inside shore-side 16 of the gate elements 1*a*, 1*b*, 1*c*, 1*d*, that on the river- side end edge 14, there are contact surfaces with a bead-like shape on the dam wall 11, and that the seals 15 can be pressed by water pressure against the bead-shaped contact surfaces 17 of the next-higher gate element 1*b*, 1*c*, 1*d*.

A still yet further feature of the invention resides broadly in a barrier characterized by the fact that on the bottom edges 3 of the dam wall 11, solid plates 33 are installed which project ahead of the dam wall 11 and have on their underside 34 a rubber profile 35, which runs along the bottom edges 3 of the dam wall 11 and that there are contact surfaces 27 on the foundation 2 in front of the dam wall 11, whereby the plates 33 can be pressed by the water pressure against the contact surfaces 27.

A yet further feature of the invention resides broadly in a barrier characterized by the fact that the gate elements 1*a*, 1*b*, 1*c*, 1*d* have closable openings in their dam walls 11, by means of which a pressure equalization becomes possible during extension into the closed position.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A barrier apparatus for retaining water in a body of water, such as for damming a tidal waterway in the event of a storm tide, the body of water having a bottom, a first shore and a second shore, said barrier apparatus comprising:

a plurality of barrier elements for retaining water;

at least some of said barrier elements being adjacent to one another; and said plurality of barrier elements having means for telescopically retracting at least some of said barrier elements into adjacent barrier elements and for telescopically extending at least some of said barrier elements such that said barrier apparatus extends towards the first shore during the extending of at least some of said barrier elements.

2. The barrier apparatus according to claim 1, further comprising a foundation, wherein at least a portion of said foundation is for being disposed substantially on the bottom of the body of water.

3. The barrier apparatus according to claim 2, wherein at least some of said barrier elements are movably disposed and are telescopically retractable and extendable on said foundation.

4. The barrier apparatus according to claim 3, wherein:

said foundation comprises at least one inclined plane surface; and said barrier elements are movably disposed and telescopically retractable and extendable on said at least one inclined plane surface.

5. The barrier apparatus according to claim 4, wherein:

at least some of said barrier elements have a longitudinal axis of movement;

said at least some of said barrier elements are movably disposed and telescopically retractable and extendable in a direction substantially parallel to said longitudinal axis of movement; and at least one of said barrier elements has a substantially triangular cross-section in a direction substantially perpendicular to said longitudinal axis of movement.

6. The barrier apparatus according to claim 5, wherein each of at least one of said barrier elements has a size different from at least one other of said barrier elements.

7. The barrier apparatus according to claim 6, wherein:

at least one of said barrier elements has at least one rest position on at least one of the first and second shores; and at least some of said barrier elements are telescopically retractable into said at least one rest position.

8. The barrier apparatus according to claim 7, wherein said at least one rest position is disposed out of the body of water.

9. The barrier apparatus according to claim 8, wherein:

the body of water has a region of substantial depth; and said foundation is disposed to guide the movement of at least one of said barrier elements between the region of substantial depth and at least one of the first and second shores.

10. The barrier apparatus according to claim 9, further comprising:

a closed position of said barrier apparatus substantially closing the body of water; and at least some of said barrier elements being extendable into said closed position such that said barrier apparatus substantially retains water in the body of water.

11. The barrier apparatus according to claim 10, wherein at least one of said barrier elements comprises sealing means for sealing gaps between said at least one barrier element and an adjacent barrier element when said barrier apparatus is in said closed position.

12. The barrier apparatus according to claim 11, wherein each of at least one of said barrier elements comprises a first wall and a second wall, said first wall being for retaining water in the body of water when said barrier apparatus is in said closed position.

13. The barrier apparatus according to claim 12, wherein said first wall of said at least one of said barrier elements comprises at least one of:

a substantially flat external surface; and a curved external surface.

14. The barrier apparatus according to claim 13, wherein said second wall of said at least one barrier element comprises a frame structure for supporting said first wall.

15. The barrier apparatus according to claim 14, wherein:

each of said barrier elements comprises a first side edge and a second side edge;

at least one of each of said first and second side edges of each barrier element is for interfacing with one of said first and second side edges of another of said barrier elements when said barrier apparatus is in said closed position;

said first and second side edges of each barrier element are oriented in a substantially vertical direction.

16. The barrier apparatus according to claim 15, wherein:

at least one of said barrier elements comprises a bead-shaped contact surface on one of said first and second edges; and said bead-shaped contact surface is disposed to interface with said sealing means of an adjacent barrier element when said barrier apparatus is in said closed position.

17. The barrier apparatus according to claim 16, further comprising:

a first portion and a second portion;

each of said first portion and said second portion comprising at least some of said barrier elements each of said first and second portions of said barrier apparatus comprising between about three and about five of said barrier elements;

the vertical dimension with respect to the depth of said foundation of a largest of said barrier elements of each said half of said barrier apparatus being between about 25 meters and about 30 meters;

each of said barrier elements having a horizontal dimension in a direction substantially parallel to said longitudinal axis of movement;

said horizontal dimension of each of at least some of said barrier elements being between about 100 meters and about 200 meters;

said foundation comprising a concrete material;

said foundation comprising at least one gallery, said gallery being disposed in a substantially longitudinal direction;

said gallery having a substantially rectangular cross-section;

said foundation comprising tracks;

each of said tracks having a substantially trough-shaped cross-section;

each of said tracks comprising two flank portions and a central portion, said central portion being disposed between said flank portions;

each of said flank portions having an angle of inclination with respect to said central portion;

said angle of inclination of each of said flank portions being about 45 degrees;

each of said first wall and said second wall of at least some of said barrier elements having a lower portion;

each said lower portion comprising rollers;

said rollers being disposed in said tracks;

said rollers comprising two sets of at least one roller;

said rollers being disposed to travel on said flank portions;

said rollers of each of said sets being oriented substantially at a right angle with respect to said rollers of the other of said sets;

each of at least some of said gate elements comprising skinplates;

said flank portions of said tracks comprising reinforcements;

said rollers being disposed to travel on said reinforcements;

each of said reinforcements being substantially in the shape of an H-beam;

each said lower portion comprising skids;

said first wall of each of at least some of said barrier elements comprising a lower edge;

each of at least one of said barrier elements comprising a plate disposed on said lower edge;

said plate having a lower side;

said plate comprising a profile disposed on said lower side;

said profile comprising a rubber material;

said foundation comprising at least one contact surface;

said at least one contact surface being disposed under said plate of each of at least one of said barrier elements;

said at least one contact surface being oriented in a direction substantially parallel to each of at least one of said barrier elements;

said profile for being displaced, under water pressure, into contact with said contact surface;

each of at least one of said barrier elements comprising at least one sweeper element for sweeping at least one of said tracks;

said at least one sweeper element being disposed on at least one said lower edge;

said at least one sweeper element comprising at least one plate;

said foundation comprising at least one water pipe;

said at least one water pipe being disposed at least partly in at least one of said tracks;

said at least one water pipe comprising nozzles; and said nozzles being for discharging pressurized water for flushing at least one of said tracks.

18. A method of utilizing a barrier apparatus for retaining water in a body of water, such as for damming a tidal waterway in the event of a storm tide, the body of water having a bottom, a first shore and a second shore, the barrier apparatus comprising:

a plurality of barrier elements for retaining water;

at least some of the barrier elements being adjacent to one another; and the plurality of barrier elements having means for telescopically retracting at least some of the barrier elements into adjacent barrier elements and for telescopically extending at least some of the barrier elements such that the barrier apparatus extends towards the first shore during the extending of at least some of the barrier elements; and said method comprising the steps of:

telescopically extending at least some of the barrier elements such that the barrier apparatus extends towards the first shore during said step of telescopically extending and retains water in the body of water; and telescopically retracting at least some of said barrier elements into adjacent barrier elements.

19. The method according to claim 18, wherein:

the barrier apparatus further comprises a foundation;

at least a portion of the foundation is for being disposed substantially on the bottom of the body of water.

20. The method according to claim 19, wherein at least some of said barrier elements are movably disposed and are telescopically retractable and extendable on the foundation.

* * * * *